US005318695A

United States Patent [19]

Eberly et al.

[11] Patent Number: 5,318,695

[45] Date of Patent: * Jun. 7, 1994

[54] FLUID CRACKING PROCESS FOR PRODUCING LOW EMISSIONS FUELS

[75] Inventors: Paul E. Eberly; William E. Winter, both of Baton Rouge; William L. Schuette, New Roads; William A. Wachter; Tan-Jen Chen, both of Baton Rouge, all of La.

[73] Assignee: Exxon Research and Engineering Company, Florham Park, N.J.

[ * ] Notice: The portion of the term of this patent subsequent to May 24, 2011 has been disclaimed.

[21] Appl. No.: 982,933

[22] Filed: Nov. 30, 1992

[51] Int. Cl.[5] ..... C10G 11/00; C10G 11/02

[52] U.S. Cl. ..... 208/120; 208/118; 208/113; 208/121; 208/122; 208/61; 208/85

[58] Field of Search ..... 208/57, 61, 85, 113, 208/118, 120, 120 MC, 121, 122

[56] References Cited

U.S. PATENT DOCUMENTS 4,780,193 10/1988 Derr, Jr. et al. ..... 208/61

OTHER PUBLICATIONS

Avidan et al., "Innovative Improvements Highlight FCC's Past and Future", Oil and Gas Journal, Jan. 8, 1990.

Avidan, "Recent and Future Developments in FCC", 1991, pp. 43–64.

*Primary Examiner*—R. Bruce Breneman
*Assistant Examiner*—Walter D. Griffin
*Attorney, Agent, or Firm*—Henry E. Naylor

[57] ABSTRACT

A fluid catalytic cracking process for producing relatively low emissions fuels. The feedstock is exceptionally low in nitrogen and aromatics and relatively high in hydrogen. The catalyst is an amorphous silica-alumina or a zeolitic material having a relatively small unit cell size. The feedstock can be characterized as having less than about 50 wppm nitrogen; greater than about 13 wt. % hydrogen; less than about 7.5 wt. % 2+ring aromatic cores; and not more than about 15 wt. % aromatic cores overall.

7 Claims, 3 Drawing Sheets

FLUID CRACKING PROCESS FOR PRODUCING LOW EMISSIONS FUELS

FIELD OF THE INVENTION

The present invention relates to a fluid catalytic cracking process for producing low emissions fuels. The feedstock is exceptionally low in nitrogen and aromatics and relatively high in hydrogen. The catalyst is an amorphous silica-alumina material or a zeolitic material having a relatively small unit cell size. The feedstock can be characterized as having less than about 50 wppm nitrogen; greater than about 13 wt. % hydrogen; less than about 7.5 wt. %o 2+ring aromatic cores; and not more than about 15 wt. % aromatic cores overall.

BACKGROUND OF THE INVENTION

Catalytic cracking is an established and widely used process in the petroleum refining industry for converting petroleum oils of relatively high boiling point to more valuable lower boiling products, including gasoline and middle distillates, such as kerosene, jet fuel and heating oil. The pre-eminent catalytic cracking process now in use is the fluid catalytic cracking process (FCC) in which a pre-heated feed is brought into contact with a hot cracking catalyst which is in the form of a fine powder, typically having a particle size of about 10–300 microns, usually about 100 microns, for the desired cracking reactions to take place. During the cracking, coke and hydrocarbonaceous material are deposited on the catalyst particles. This results in a loss of catalyst activity and selectivity. The coked catalyst particles, and associated hydrocarbon material, are subjected to a stripping process, usually with steam, to remove as much of the hydrocarbon material as technically and economically feasible. The stripped particles containing non-strippable coke, are removed from the stripper and sent to a regenerator where the coked catalyst particles are regenerated by being contacted with air, or a mixture of air and oxygen, at elevated temperature. This results in the combustion of the coke which is a strongly exothermic reaction which, besides removing the coke, serves to heat the catalyst to the temperatures appropriate for the endothermic cracking reaction. The process is carried out in an integrated unit comprising the cracking reactor, the stripper, the regenerator, and the appropriate ancillary equipment. The catalyst is continuously circulated from the reactor or reaction zone, to the stripper and then to the regenerator and back to the reactor. The circulation rate is typically adjusted relative to the feed rate of the oil to maintain a heat balanced operation in which the heat produced in the regenerator is sufficient for maintaining the cracking reaction with the circulating regenerated catalyst being used as the heat transfer medium. Typical fluid catalytic cracking processes are described in the monograph Fluid Catalytic Cracking with Zeolite Catalysts, Venuto, P. B. and Habib, E. T., Marcel Dekker Inc. N.Y. 1979, which is incorporated herein by reference. As described in this monograph, catalysts which are conventionally used are based on zeolites, especially the large pore synthetic faujasites, zeolites X and Y.

Typical feeds to a catalytic cracker can generally be characterized as being a relatively high boiling oil or residuum, either on its own, or mixed with other fractions, also usually of a relatively high boiling point. The most common feeds are gas oils, that is, high boiling, non-residual oils, with an initial boiling point usually above about 230° C., more commonly above about 350° C., with end points of up to about 620° C. Typical gas oils include straight run (atmospheric) gas oil, vacuum gas oil, and coker gas oils.

While such conventional fluid catalytic cracking processes are suitable for producing conventional transportation fuels, such fuels are generally unable to meet the more demanding requirements of low emissions fuels. To meet low emissions standards, the fuel products must be relatively low in sulfur, nitrogen, and aromatics, especially multiring aromatics. Conventional fluid catalytic cracking is unable to meet such standards. These standards will require either further changes in the FCC process, catalysts, or post-treating of all FCC products. Since post-treating to remove aromatics from gasoline or distillate fuels is particularly expensive, there are large incentives to limit the production of aromatics in the FCC process. Consequently, there exists a need in the art for methods of producing large quantities of lower emissions transportation fuels, such as gasoline and distillates, with lower emissions.

SUMMARY OF THE INVENTION

In accordance with the present invention, there is provided a fluid catalytic cracking process for producing low emissions fuel products, which process comprises:

(a) introducing a hydrocarbonaceous feedstock into a reaction zone of a catalytic cracking unit, which feedstock is characterized as having an initial boiling point from about 230° C. to about 350° C., with end points up to about 620° C.; a nitrogen content less than about 50 wppm; a hydrogen content in excess of about 13 wt. %; a 2+ring aromatic core content of less than about 7.5 wt. %; and an overall aromatic core content of less than about 15 wt. %;

(b) catalytically cracking said feedstock in said reaction zone at a temperature from about 450° C. to about 600° C., by causing the feedstock to be in contact with a cracking catalyst for a contact time of about 0.5 to 10 seconds, which cracking catalyst is selected from the group consisting of: (a) an amorphous silica-alumina material; and (b) a zeolitic material having a unit cell size less than about 24.25 Å; thereby producing lower boiling products and spent catalyst particles which contain coke and hydrocarbon; and (c) stripping said spent catalyst particles with a stripping medium in a stripping zone to remove therefrom at least a portion of said hydrocarbon;

(d) recovering said stripped hydrocarbon from the stripping zone;

(e) regenerating said coked catalyst in a regeneration zone by burning off a substantial amount of the coke on said catalyst, and optionally an added fuel component, to maintain the regenerated catalyst at a temperature which will maintain the catalytic cracking reactor at a temperature from about 450° C. to about 600° C.; and (f) recycling said regenerated catalyst to the reaction zone, In preferred embodiments of the present invention, an added fuel component is used in the regeneration zone and is selected from: $C_2-$ light gases from the catalytic cracking unit, natural gas, and any other non-residual petroleum refinery stream in the appropriate boiling range.

In preferred embodiments of the present invention the catalyst is an amorphous silica-alumina having about 10 to 40 wt. % alumina.

In other preferred embodiments of the present invention the contact time is about 0.5 to 3 seconds.

DETAILED DESCRIPTION OF THE INVENTION

Figure 1:
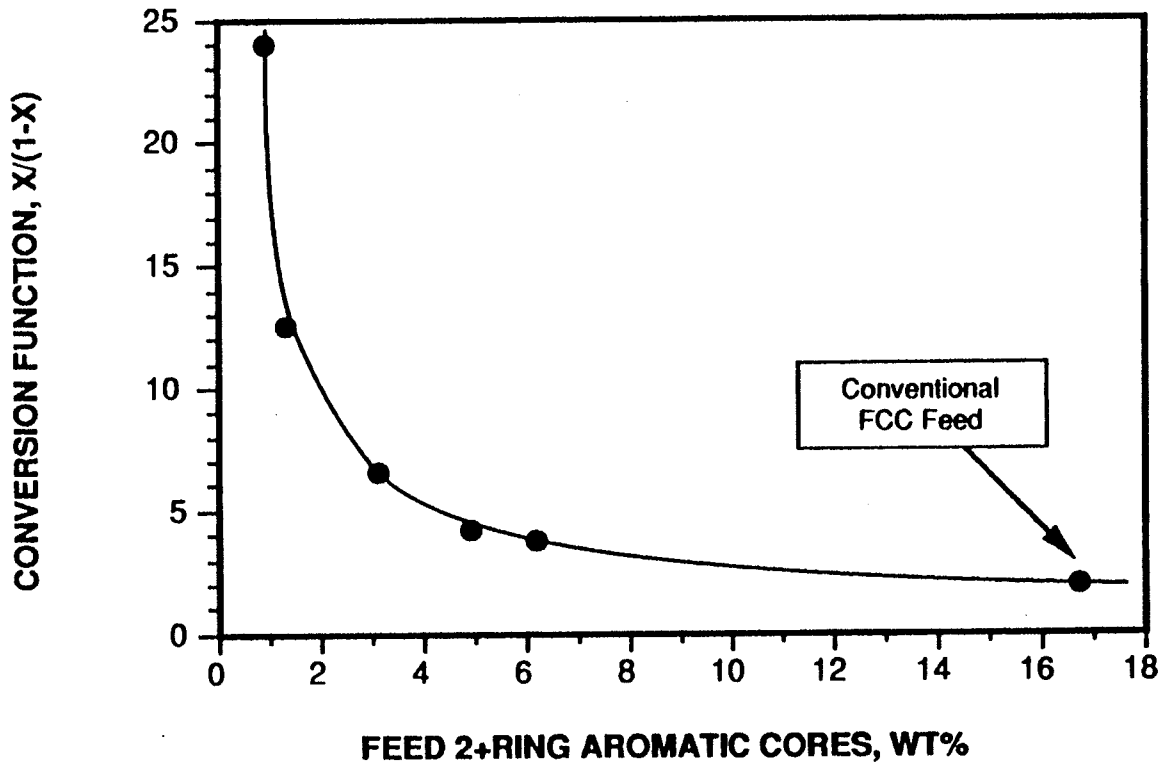
FIG. 1 graphically illustrates that conversion and naphtha yields increase as feed aromatics and nitrogen are reduced.

The practice of the present invention results in the production of less aromatic naphtha products as well as the production of more $C_3$ and $C_4$ olefins which can be converted to high octane, non-aromatic alkylates, and methyl tertiary butyl ether.

Feedstocks which are suitable for being converted in accordance with the present invention are any of those hydrocarbonaceous feedstocks which are in the boiling point range of conventional feedstocks for fluid catalytic cracking. Such streams typically have an initial boiling point of about 230° C. to about 350° C., with an end point up to about 620° C. The feedstocks of the present invention must also contain no more than about 50 wppm nitrogen, no more than about 7.5 wt. % 2+ring aromatic cores no more than about 15 wt. % aromatic cores overall, and at least about 13 wt. % hydrogen. Non-limiting examples of such feeds include the non-residual petroleum based oils such as straight run (atmospheric) gas oil, vacuum gas oil, and coker gas oil. Other oils may also be used, such as those from synthetic sources which are normally liquid or solid, such as coal and oil-shale, and which may be catalytically cracked, either on their own or in admixture with oils of petroleum origin. Such oils from synthetic sources will typically be comprised of a mixture of aromatics, paraffins, and cyclic paraffins. Feedstocks which are suitable for use in the practice of the present invention may not be readily available in a refinery. This is because typical refinery streams in the boiling point range of interest, and which are conventionally used for fluid catalytic cracking, generally contain too high a content of undesirable components such as nitrogen, sulfur, and aromatics. Consequently, such streams will need to be upgraded, or treated, to lower the level of such undesirable components. Non-limiting methods for upgrading such streams include hydrotreating in the presence of hydrogen and a supported Mo containing catalyst with Ni and/or Co; extraction methods, including solvent extraction as well as the use of solid absorbents, such as various molecular sieves. It is preferred to hydrotreat the streams.

Any suitable conventional hydrotreating process can be used as long as it results in a stream having the characteristics of nitrogen, sulfur, and aromatics level as previously mentioned. That is nitrogen levels of less than about 50 wppm, preferably less than about 30 wppm, more preferably less than about 15 wppm, and most preferably less than about 5 wppm; a hydrogen content of greater than about 13 wt. %, preferably greater than about 13.5 wt. %; a 2+ring aromatic core content of less than about 7.5 wt. %, preferably less than about 4 wt. %; and an overall aromatic core content of less than about 15 wt. %, preferably less than about 8 wt. %.

Suitable hydrotreating catalysts are those which are typically comprised of a Group VIB (according to the Sargent-Welch Scientific Company Periodic Table of the Elements) metal with one or more Group VIII metals as promoters, on a refractory support. It is preferred that the Group VIB metal be molybdenum or tungsten, more preferably molybdenum. Nickel and cobalt are the preferred Group VIII metals with alumina being the preferred support. The Group VIII metal is present in an amount ranging from about 2 to 20 wt. %, expressed as the metal oxides, preferably from about 4 to 12 wt. %. The Group VIB metal is present in an amount ranging from about 5 to 50 wt. %, preferably from about 10 to 40 wt. %, and more preferably from about 20 to 30 wt. % and are expressed as metal oxides. All metals weight percents are based on the total weight of the catalyst. Supports suitable for such catalysts are typically inorganic oxides, such as alumina, silica, silica-alumina, titania, and the like. Preferred is alumina.

Suitable hydrotreating conditions include temperatures ranging from about 250° to 450° C., preferably from about 350° C. to 400° C.; pressures from about 250 to 3000 psig; preferably from about 1500 to 2500 psig; hourly space velocities from about 0.05 to 6 V/V/Hr; and a hydrogen gas rate of about 500 to 10000 SCF/B; where SCF/B means standard cubic feet per barrel, and V/V/Hr means volume of feed per volume of catalyst per hour.

A hydrocarbonaceous feedstock which meets the aforementioned requirements for producing a low emissions fuel is fed to a conventional fluid catalytic cracking unit. The catalytic cracking process may be carried out in a fixed bed, moving bed, ebullated bed, slurry, transfer line (dispersed phase), riser or dense bed fluidized bed operation. It is preferred that the catalytic cracking unit be a fluid catalytic cracking (FCC) unit. Such a unit will typically contain a reactor where the hydrocarbonaceous feedstock is brought into contact with hot powdered catalyst particles which were heated in a regenerator. Transfer lines connect the two vessels for moving catalyst particles back and forth. The cracking reaction will preferably be carried out at a temperature from about 450° to about 680° C., more preferably from about 480° to about 560° C.; pressures from about 5 to 60 psig, more preferably from about 5 to 40 psig; contact times (catalyst in contact with feed) of about 0.5 to 15 seconds, more preferably about 1 to 6 seconds; and a catalyst to oil ratio of about 0.5 to 10, more preferably from about 2 to 8. During the cracking reaction, lower boiling products are formed and some hydrocarbonaceous material, and non-volatile coke are deposited on the catalyst particles. The hydrocarbonaceous material is removed by stripping, preferably with steam. The non-volatile coke is typically comprised of highly condensed aromatic hydrocarbons which generally contain about 4 to 10 wt. % hydrogen. As hydrocarbonaceous material and coke build up on the catalyst, the activity of the catalyst for cracking, and the selectivity of the catalyst for producing gasoline blending stock, is diminished. The catalyst particles can recover a major proportion of their original capabilities by removal of most of the hydrocarbonaceous material by stripping and the coke by a suitable oxidative regeneration process. Consequently, the catalyst particles are sent to a stripper and then to a regenerator.

Catalyst regeneration is accomplished by burning the coke deposits from the catalyst surface with an oxygen-containing gas, such as air. Catalyst temperatures during regeneration may range from about 560° C. to about 760° C. The regenerated, hot catalyst particles are then transferred back to the reactor via a transfer line and, because of their heat, are able to maintain the reactor at the temperature necessary for the cracking reactions. Burning coke is an exothermic reaction, therefore in a conventional fluid catalytic cracking unit with conventional feeds, no additional fuel to produce heat is needed. The feedstocks used in the practice of the present invention, primarily because of their low level s of aromatics, and al so due to the relatively short contact times in the reactor or transfer line, may not deposit enough coke on the catalyst particles to achieve the necessary temperatures in the regenerator. Therefore, it may be necessary to add fuel to increase temperatures in the regenerator so the catalyst particles returning to the reactor are hot enough to maintain the cracking reactions. Non-limiting examples of suitable additional fuel include $C_2^-$ gases from the catalytic cracking process itself, natural gas, and any other non-residual petroleum refinery stream in the appropriate boiling range. Such additional liquid fuels are sometimes referred to as torch oils. Preferred are the $C_2^-$ gases.

Catalysts suitable for use in the present invention are selected from: (a) amorphous solid acids, such as alumina, silica-alumina, silica-magnesia, silica-zirconia, silica-thoria, silica-beryllia, silica-titania, and the like; and (b) zeolite catalysts containing faujasite having a unit cell size of about 24.25 Å or less. Silica-alumina material s suitable for use in the present invention are amorphous materials containing about 10 to 40 wt. % alumina and to which other promoters may or may not be added.

Zeolitic materials suitable for use in the practice of the present invention are zeolites which are iso-structural to zeolite Y and which have a unit cell size equal to or less than about 24.25 Å. The particle size of the zeolite may range from about 0.1 to 10 microns, preferably from about 0.3 to 3 microns. The zeolite will be mixed with a suitable porous matrix material when used as a catalyst for fluid catalytic cracking. Non-limiting porous matrix materials which may be used in the practice of the present invention include alumina, silica-alumina, silica-magnesia, silica-zirconia, silica-thoria, silica-beryllia, silica-titania, as well as ternary compositions, such as silica-alumina-thoria, silica-alumina-zirconia, magnesia and silica-magnesia-zirconia. The matrix may also be in the form of a cogel. The relative proportions of zeolite component and inorganic oxide gel matrix on an anhydrous basis may vary widely with the zeolite content, ranging from about 10 to 99, more usually from about 10 to 80, percent by weight of the dry composite. The matrix itself may possess catalytic properties, generally of an acidic nature.

Suitable amounts of zeolite component in the total catalyst will generally range from about 1 to about 60, preferably from about 1 to about 40, and more preferably from about 5 to about 40 wt. %, based on the total weight of the catalyst. Generally, the particle size of the total catalyst will range from about 10 to 300 microns in diameter, with an average particle diameter of about 60 microns. The surface area of the matrix material will be about $\leqq 350$ $m^2/g$, preferably 50 to 200 $m^2/g$, more preferably from about 50 to 100 $m^2/g$. While the surface area of the final catalysts will be dependent on such things as type and amount of zeolite material used, it will usually be less than about 500 $m^2/g$, preferably from about 50 to 300 $m^2/g$, more preferably from about 50 to 250 $m^2/g$, and most preferably from about 100 to 250 $m^2/g$.

EXAMPLE 1

Cracking tests were conducted in a microactivity test (MAT) unit. Such a test unit is described in the Oil and Gas Journal, 1966 Vol.64, pages 7, 84, 85 and Nov. 22, 1971, pages 60–68, which is incorporated herein by reference. Run conditions in the MAT unit were as follows:

| | |
|---|---|
| Temperature, °C. | 525 |
| Run Time, Sec. | 30 |
| Catalyst Charge, gr. | 4.1 |
| Amount Feed, cc. | 1.1 |
| Cat/Oil ratio | 4.2 to 4.5 |

Tests were made with a fresh, steamed, catalyst (ZA) commercially available from Davison under the tradename Octacat. The catalyst was steamed for 16 hours at 760° C. to simulate a commercially deactivated catalyst. Catalyst ZA contains a USY zeolite but no rare earths. It is formulated in a silica-sol matrix and after steaming, or commercial deactivation, it is a relatively low unit cell size catalyst, which makes it a catalyst of the present invention. The composition and properties of catalyst ZA are as follows:

| | |
|---|---|
| $Al_2O_3$ | 26.0 wt. % |
| $SiO_2$ | 73.0 |
| $Re_2O_3$ | 0.02 |
| $Na_2O_3$ | 0.25 |
| After calcination for 4 hrs at 538° C. | |
| Surface Area, $m^2/g$ | 297.5 |
| Pore Volume, cc/g | 0.24 |
| Unit Cell Size, Å | 24.44 |
| After steaming for 16 hrs at 405° C. | |
| Surface Area, $m^2/g$ | 199.5 |
| Pore Volume, cc/g | 0.20 |
| Unit Cell Size, Å | 24.25 |

A raw, and several hydrotreated Arab Light VGO (virgin gas oil) streams, were used as feeds for catalytic cracking experiments. Hydrotreating conditions ranged from 1200 to 2000 psig hydrogen, 370° to 380° C., and 0.15 to 1.5 liquid hourly space velocity (LHSV). A commercially available NiMo/alumina catalyst, available from Ketjen as catalyst KF-843, was used to hydrotreat the feeds. The hydrotreated feeds are designated by HA and the 345° C.+fraction of HA is designated HA+. A number is al so provided indicating the hydrotreating severity which increases from HA5 to HA1. The raw Arab light vacuum gas oil (VGO) is designated as RA, with the 345° C.+ fraction being designated RA+. Arab Light VGO is a typical, conventional feedstock for fluid catalytic cracking. The properties of the raw and hydrotreated feeds are set forth in Table I below.

TABLE I

| Properties of Raw and Hydrotreated Arab Light VGO | HA5 | HA4 | HA3 | HA2 | HAI | RA |
|---|---|---|---|---|---|---|
| W ppm N | 130 | 40 | 4 | 0.7 | <.5 | 596 |
| Wt. % S | 0.08 | 0.03 | <0.01 | <0.01 | <0.01 | 1.99 |
| Wt. % C | 86.90 | 86.90 | 86.44 | 86.11 | 85.70 | 85.86 |
| Wt. % H | 13.10 | 13.10 | 13.56 | 13.89 | 14.30 | 12.09 |
| Wt. % Saturates | 62.3 | 65.4 | 79.9 | 93.7 | 95.7 | 47.8 |
| Wt. % 1 Ring Aromatics | 27.8 | 26.7 | 15.7 | 4.2 | 2.3 | 17.1 |
| Wt. % Total Arom. Cores | 11.3 | 10.0 | 6.4 | 2.0 | 1.3 | 21.5 |
| Wt. % 2+ Ring Cores | 6.3 | 5.0 | 3.2 | 1.4 | 1.0 | 16.8 |

The total liquid product from the MAT tests amounted to about 0.3 to 0.7 grams and was analyzed using two different gas chromatograph instruments. A standard analysis was the boiling point distribution determined by gas chromatographic distillation (GCD) to evaluate: (1) the amount of material boiling less than 15° C.; (2) naphtha boiling between 15° C. and 220° C.; (3) light cat cycle oil (LCCO) boiling between 220° C. and 345° C.; and (4) bottoms boiling above 345° C. For selected tests, another portion of the sample was analyzed on a PIONA instrument which is a multidimensional gas chromatograph (using several columns) to determine the molecular types according to carbon number from $C_3$ to $C_{11}$. The types include normal paraffins, isoparaffins, naphthenes, normal olefins, iso-olefins, cyclo-olefins, and aromatics.

Detailed cracking data are given in Table II below for the raw and hydrotreated Arab Light VGO feeds.

TABLE II

| Cracking of Hydrotreated and Raw Arab Lt. VGO on Catalyst ZA | | | | | | |
|---|---|---|---|---|---|---|
| Feed | HA5+ | HA4+ | HA3+ | HA2+ | HA1+ | RA+ |
| Conversion (220° C.) | 79.4 | 80.8 | 87.0 | 92.6 | 96.0 | 67.1 |
| Yields, Wt % | | | | | | |
| Coke | 2.1 | 2.02 | 1.55 | 1.45 | 1.82 | 2.35 |
| Dry Gas | 2.09 | 1.95 | 2.00 | 1.85 | 1.70 | 2.17 |
| $C_3H_6$ | 6.09 | 6.63 | 6.69 | 7.27 | 9.79 | 4.7 |
| $C_3H_8$ | 1.08 | 1.11 | 1.10 | 1.28 | 1.39 | 0.95 |
| $C_4H_8$ | 7.38 | 6.66 | 8.10 | 8.95 | 10.53 | 5.9 |
| Iso-$C_4H_{10}$ | 6.24 | 6.77 | 7.63 | 9.28 | 9.90 | 4.2 |
| N—$C_4H_{10}$ | .867 | .971 | .985 | .98 | 1.54 | .88 |
| 15-220° C. Naphtha | 53.5 | 54.6 | 58.8 | 61.5 | 59.3 | 45.9 |
| LCCO[1] | 13.2 | 12.5 | 9.3 | 5.85 | 3.7 | 15.6 |
| Bottoms[2] | 7.4 | 6.7 | 3.7 | 1.6 | 0.3 | 17.2 |
| 15-220° C. Naphtha | | | | | | |
| Aromatics | 29.9 | 29.4 | 25.6 | 25.2 | 21.8 | 32.4 |
| Olefins | 20.2 | 20.2 | 21.2 | 18.9 | 21.7 | 27.6 |
| $C_3 + C_4$ Olefins/Sats | 1.64 | 1.50 | 1.52 | 1.41 | 1.58 | 1.76 |

[1]light catalytic cycle oil, bp 220°-345° C.
[2]bottoms, bp 345° C.+

The above table shows that conversion and naphtha yields increase sharply as feed aromatics and nitrogen are reduced. The conversion data are analyzed to provide estimates of feed crackability, using a conversion function $(X/(1-X))$ in which X is the conversion of the feed to compounds boiling below about 220° C. The results are plotted in FIG. 1 hereof. It becomes evident that the crackability of the Arab Light VGO can be dramatically improved by hydrotreating. Reducing 2+ring aromatic content from 17 wt. % to 6 wt.%, or increasing hydrogen content from 12.1 wt. % to 13.1 wt. %, by hydrotreating increased crackability in the MAT test unit by a factor of 2. Crackability, as measured by the above conversion function continued to increase as 2+ring aromatic cores and organic nitrogen were reduced and hydrogen content of the hydrotreated feeds increased. In fact, from FIG. 1 hereof, it appears that the biggest increase in crackability occurred at a hydrogen content of at least about 13.5 wt. % or more, a 2+ring aromatic content of about 3.5 wt. % or less, and an organic nitrogen content of 5 wppm or less.

Coke yields were also substantially reduced. Since coke yields are a function of both feedstock properties and conversion, coke yields did not continue to decrease as feed aromatic cores/nitrogen was reduced and conversion increased. Yields of $C_2$— dry gas were down slightly versus the raw feed. The effect was small since dry gas yields are also affected by conversion.

In addition to their high crackability, aromatic contents of naphthas (cat naphtha) produced by the catalytic cracking process hereof from the hydrotreated feeds are lower than aromatic content of the naphtha produced from the conventional fluid catalytic cracking feed-raw VGO. For the most severely hydrotreated feeds, cat naphtha aromatics were about two-thirds the level contained in cat naphtha produced from the RA+ feed. The reduction in product naphtha aromatics is substantially less than the reduction in feed aromatics because of increased conversion. Product aromatics normally increase as conversion increases. Hydrogen transfer reactions actually produce aromatic compounds from the clean feeds at high conversions, even with a low unit cell size, reduced hydrogen transfer zeolite catalyst. Nonetheless, the net effect of cracking clean feeds with low unit cell size catalysts is a significant reduction in product aromatics, even as conversion increased substantially.

Yields of $C_3$ and $C_4$ olefins are especially enhanced as aromatic cores and organic nitrogen are reduced. Propylene plus butylene yields essentially doubled when running a relatively clean feed containing only about 1 wt. % aromatic cores and less than about 0.5 wppm nitrogen. Propylene and butylene yields produced from the hydrotreated, feeds can be used to produce alkylate and oxygenates, such as methyl tertiary butyl ether (MTBE). Blending high octane, non-aromatic alkylate and MTBE will reduce aromatics concentrations in the mogas pool and reduce the level of high octane aromatic materials, such as reformate, which must be blended into the mogas pool to maintain octane specs. These high yields of light olefins are due to the unexpected finding that good olefins selectivity is maintained at relatively high conversions with feeds and catalysts of this invention. Normally, in conventional fluid catalytic cracking, the ratio of $C_3$ and $C_4$ olefins to saturates decreases sharply as conversion increases. Olefin selectivities were somewhat lower for the hydrotreated feeds then for the raw non-hydrotreated feeds using a low unit cell size catalyst, but $C_3$ plus $C_4$ olefins to saturates ratios were much higher than expected at very high conversion.

EXAMPLE 2 (COMPARATIVE)

Cracking tests were conducted with conventional feeds in the MAT test unit and using the same operating conditions described in Example 1 above. The tests do not represent the present invention and were made as a comparison with the more favorable results disclosed in Example 1 above.

Tests were made with three fresh, steamed catalysts which are designated as catalysts ZB, ZC, and ZD. These catalysts were steamed 16 hours at 760° C. to simulate commercially deactivated catalysts. Catalyst ZB is similar to catalyst ZA described in Example 1. It contained a USY zeolite (LZY-82) and no rare earths. It was formulated in a silica-sol matrix and contained kaolin clay as well. It is also a relatively low unit cell size catalyst after steaming, or commercial deactivation, so that it is a catalyst of this invention. Catalysts ZC and ZD are not catalysts of this invention. They contain a partially rare-earth-exchanged zeolite (ADZ-30) which is an intermediate unit cell size (>24.25 A) zeol ire after steaming, or commercial deactivation. Catalyst ZC was formulated with an alumina sol and clay binder. Catalyst ZD was formulated with a silica sol and clay binder. Properties of these catalysts are given in Table III below.

TABLE III

| Catalyst | Zeolite Content, wt % | Zeolite Unit Cell, Å | Pore Volume, cc/gm | Surface Area, sq m/gm |
|---|---|---|---|---|
| ZB | 40 | 24.23 | 0.302 | 189 |
| ZC | 40 | 24.31 | 0.194 | 224 |
| ZD | 40 | 24.31 | 0.177 | 224 |

The feed used for these experiments was 345° C./540° C. vacuum gas oil stream, which was a conventional fluid catalytic cracking feedstock obtained from a commercial refinery. The feed is similar to the raw Arab Light VGO used in Example 1 above. It is not a clean feed as defined in this invention. The feed is designated Feedstock RB and its properties are set forth in Table IV below

TABLE IV

| Feed "RB" Properties | |
|---|---|
| W ppm N | 633 |
| Wt % S | 1.15 |
| Wt % C | 86.51 |
| Wt % H | 12.23 |
| % Sats. | 54.7 |
| % 1 Ring -Aromatics | 18.7 |
| % Tot. Aromatic Cores | 14.9 |
| % 2 + Ring Aromatic Cores | 11.5 |

The total liquid product from these tests was analyzed as set forth in Example 1 above. Detailed cracking data are given in Tables V and VI below for tests made with conventional VGO feed RB, and low and intermediate unit cell size catalysts.

TABLE V

Cracking of Feed RB on INTERMEDIATE Unit Cell Size Catalyst (40% ADZ-30)

| Catalyst | ZC | ZC | ZC | ZD | ZD | ZD |
|---|---|---|---|---|---|---|
| Cat/Oil Ratio | 2.2 | 3.0 | 4.1 | 3.0 | 4.2 | 4.9 |
| Conversion (220° C.) | 75.2 | 77.6 | 79.7 | 76.8 | 77.3 | 79.2 |
| Yields, Wt % | | | | | | |
| Coke | 4.93 | 6.31 | 7.36 | 4.74 | 6.36 | 7.68 |
| Dry Gas | 3.10 | 3.32 | 3.78 | 3.04 | 3.76 | 4.64 |
| $C_3H_6$ | 4.21 | 3.53 | 3.98 | 3.83 | 3.77 | 3.93 |
| $C_3H_8$ | 1.90 | 2.18 | 2.79 | 1.78 | 2.31 | 3.35 |
| $C_4H_8$ | 3.30 | 3.31 | 3.22 | 4.05 | 3.36 | 2.88 |
| Iso-$C_4H_{10}$ | 6.02 | 6.70 | 7.87 | 6.21 | 6.70 | 8.10 |
| N—$C_4H_{10}$ | 1.78 | 1.78 | 2.14 | 1.62 | 1.83 | 2.13 |
| 15-220° C. Naphtha | 49.9 | 50.5 | 48.49 | 51.6 | 49.2 | 46.5 |
| LCCO | 16.3 | 15.6 | 14.50 | 15.8 | 15.4 | 14.4 |

TABLE V-continued

Cracking of Feed RB on INTERMEDIATE Unit Cell Size Catalyst (40% ADZ-30)

| Catalyst | ZC | ZC | ZC | ZD | ZD | ZD |
|---|---|---|---|---|---|---|
| Bottoms | 8.5 | 6.8 | 5.83 | 7.4 | 7.2 | 6.4 |
| 15-220° C. Naphtha | | | | | | |
| Aromatics | 39.5 | 42.6 | 45.4 | 40.8 | 45.9 | 49.8 |
| Olefins | 6.1 | 4.3 | 3.4 | 5.5 | 3.9 | 3.1 |
| $C_3 + C_4$ Olefins/Sats | 0.77 | 0.64 | 0.56 | 0.82 | 0.66 | 0.50 |

TABLE VI

Cracking of RB Feed with low Unit Cell Size Catalyst ZB

| Cat/Oil Ratio | 3.0 | 4.1 | 5.0 | 6.2 |
|---|---|---|---|---|
| Conversion (220° C.) | 65.3 | 70.6 | 73.8 | 74.8 |
| Yields, Wt % | | | | |
| Coke | 2.08 | 2.69 | 3.64 | 4.44 |
| Dry Gas | 2.01 | 2.65 | 3.12 | 3.28 |
| $C_3H_6$ | 4.46 | 4.74 | 5.32 | 5.59 |
| $C_3H_8$ | 0.82 | 1.00 | 1.39 | 1.53 |
| $C_4H_8$ | 5.48 | 6.08 | 6.20 | 5.83 |
| Iso-$C_4H_{10}$ | 3.78 | 4.35 | 5.59 | 6.07 |
| N—$C_4H_{10}$ | 0.83 | 0.79 | 1.08 | 1.29 |
| 15-220° C. Naphtha | 45.8 | 48.3 | 47.4 | 46.7 |
| LCCO | 18.8 | 17.9 | 16.6 | 16.0 |
| BTMS | 5.9 | 11.5 | 9.6 | 9.2 |
| 15-220° C. Naphtha | | | | |
| Aromatics | 34.6 | 38.2 | 47.6 | 43.7 |
| Olefins | 22.6 | 18.0 | 9.8 | 10.3 |
| $C_3 + C_4$ Olefins/Sats | 1.83 | 1.76 | 1.43 | 1.28 |

Figure 2:
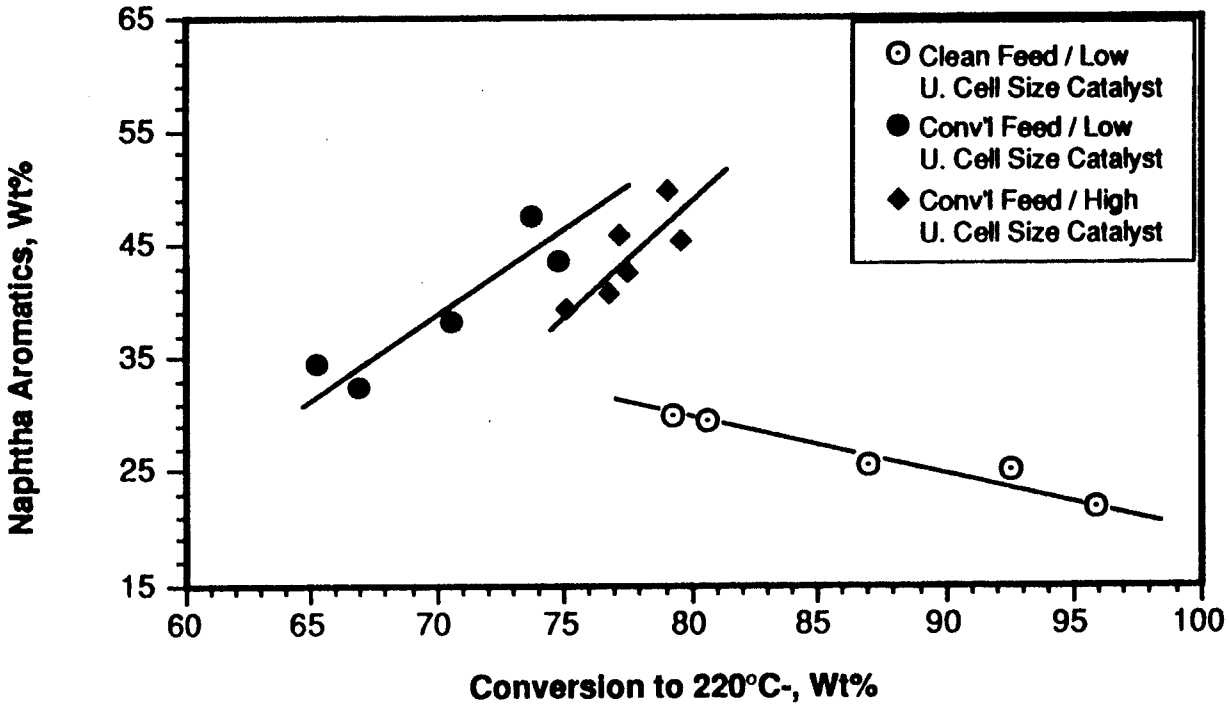
FIG. 2 shows that a naphtha produced from a relatively clean feed using a relatively low unit cell size zeolite catalyst is substantially less aromatic then a naphtha produced from a conventional FCC feed with either a relatively high or a low unit cell size catalyst.
Figure 3:
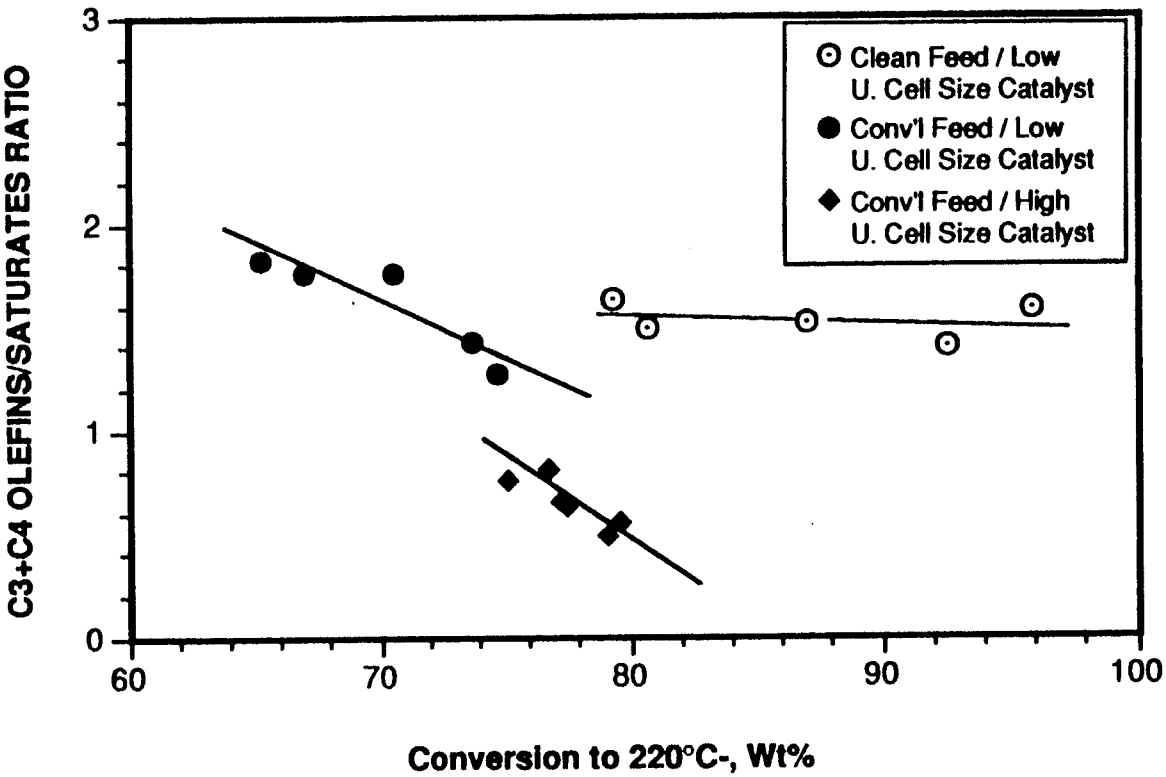
FIG. 3 shows that cracking clean FCC feeds with a relatively low unit cell size zeolite catalyst results in relatively high levels of propylene and butylene olefinicity compared to cracking conventional FCC feeds with either a low or a high unit cell size catalyst.

Cracking of conventional feed, RB, with either a low unit cell size catalyst ZB or high unit cell size catalysts, ZC or ZD, produced cat naphthas which were much more aromatic than the cat naphthas produced from the clean feeds of the present invention cracked with a low unit cell size catalyst as disclosed in Example 1 above. Propylene and butylene yields, and selectivity were also lower. The results of Examples 1 and 2 show that the low unit cell size catalysts of this invention produce cat naphthas having a relatively low aromatic content, and more propylene and butylenes from the clean feeds of this invention, but not with conventional feeds. These comparisons are illustrated in FIGS. 2 and 3 hereof.

EXAMPLE 3

Cracking tests demonstrating a preferred embodiment of this invention were conducted in the same MAT testing unit as described in Example 1 above, using the HA1 and HA2 feeds which were also described in Example 1. For these tests, a fresh steamed 3A, an amorphous silica-alumina gel catalyst, available from Davison, was used. The catalyst was steamed for 16 hours at 760° C. to simulate a commercially deactivated catalyst. Catalyst inspections for this 3A catalyst are given in Table VII below.

TABLE VII

| Catalyst: | Source | Davison |
|---|---|---|
| | Name | 3A |
| Steamed for 16 hrs @ 760° C. | S.A., $M^2/g$ | 128 |
| | P.V., cc/g | 0.49 |

Detailed results are given in Table VIII below along with comparative results from Example 1.

TABLE VIII

Cracking of Raw Arab Light VGO with Calalyst ZA vs Clean Feed with 3A @ 525° C. and 4.5 Cat/Oil

| Feed | RA | HAI | HA2 |
|---|---|---|---|
| Catalyst | ZA | 3A | 3A |
| Conversion (220° C.) | 67.1 | 69.1 | 65.0 |
| Yields Wt. % | | | |
| Coke | 2.35 | 0.37 | 0.69 |
| Dry Gas | 2.17 | 1.05 | 1.55 |
| $C_3H_6$ | 4.7 | 8.5 | 6.4 |
| $C_3H_8$ | 0.95 | 0.71 | 0.43 |
| $C_4H_8$ | 5.9 | 13.7 | 10.5 |
| Iso-$C_4H_{10}$ | 4.2 | 3.5 | 2.5 |
| N—$C_4H_{10}$ | 0.88 | 0.49 | 0.29 |
| 15-220° C. Naphtha | 45.9 | 41.1 | 42.5 |
| LCCO | 15.6 | 2.9 | 6.3 |
| Bottoms | 17.2 | 27.9 | 28.7 |
| 15 -220° C. Naphtha | | | |
| Aromatics | 32.4 | 7.5 | 13.3 |
| Olefins | 27.6 | 65.6 | 62.7 |

The above table shows that the conversion obtained with the conventional fluid catalytic cracking feed RA+ and zeolitic catalyst ZA is bracketed by the conversions obtained with the two clean feeds of this invention and the amorphous silica-alumina catalyst 3A, a catalyst of this invention. Furthermore, the naphtha produced from the clean this invention and the amorphous silica-alumina catalyst 3A, a catalyst of this invention. Furthermore, the naphtha produced from the clean feed with a preferred low hydrogen transfer catalyst (3A) of this invention is substantially less aromatic than naphtha produced by conventional fluid catalytic cracking. Also, propylene and butylene yields are higher.

EXAMPLE 4

Clean feed cracking tests were conducted in a laboratory transfer-line catalytic cracking pilot plant unit as described which can be operated to provide short contact times from about 1.5 to 5 seconds. Heated catalyst from a stirred hopper is contacted with feed and the feed/catalyst mixture is made to fall through the transfer-line reactor into a product-catalyst separator. Run conditions are selected from the ranges set forth below.

| | |
|---|---|
| Temperature, °C. | 480–485 |
| Contact Time, Sec. | 2–4 |
| Feed Rate, cc/min. | 1.5-3 |
| Cat/Oil ratio | 3-8 |

Three products were recovered for analysis: reactor gas, total liquid product, and spent catalyst. Reactor gas was analyzed by mass spectrometry and liquid product was analyzed for bromine number, also by mass spectrometry. Spent catalyst was analyzed for carbon content.

Two feeds were used for these tests. A clean feed was prepared by hydrotreating an Arab Light VGO with a commercial NiMo/alumina catalyst (KF-843) at conventional hydrotreating conditions similar to those set forth in Example 1. This feed is a feed of the invention and is designated as HA6. The second feed is a conventional commercial fluid catalytic cracking feed which is similar to the raw Arab Light VGO which was hydrotreated to produce the HA6+ feed. This conventional feed is designated as RC. Properties of the two feeds are given in Table IX below.

TABLE IX

| | HA6 | RC |
|---|---|---|
| W ppm N | 4.0 | 1057 |
| Wt % S | 0.0073 | 0.90 |
| Wt % C | 86.23 | 86.67 |
| Wt % H | 13.42 | 12.23 |
| % Saturates. | 79.8 | 59.4 |
| % 1 Ring-Aromatics | 17.9 | 17.6 |
| % Total Aromatic Cores | 4.7 | 15.2 |
| % 2 + R Ring Arom. Cores | 1.4 | 11.7 |

The HA6 feed was cracked with a fresh, steamed 3A amorphous, silica-alumina gel and with two commercial equilibrium catalysts. The first commercial catalyst was a large unit cell size catalyst and is designated as catalyst ZE. The second catalyst is an intermediate unit cell size catalyst and is designated as catalyst ZF. Detailed catalyst inspections are given in Table X below.

TABLE X

| Catalyst | Zeolite Content, Wt % | Zeolite Unit Cell, Å | Catalyst $Al_2O_3$, Wt. % | Surface Area, $m^2/gm$ |
|---|---|---|---|---|
| ZE | 15 | 24.38 | — | 80 |
| ZF | 28 | 24.27 | — | 200 |
| 3A | 0 | — | 25.0 | 122 |

Results for these cracking experiments are shown i the following two tables. Conversion obtained with the amorphous silica-alumina catalyst, 3A, and the clean feed was equivalent to conversion obtained with intermediate and high unit cell size zeolite containing catalyst and conventional feed. The key result in these experiments was that the cat naphtha produced from the HA6 feed using the amorphous silica-alumina catalyst was substantially less aromatic than naphthas produced from the conventional feed. Selectivity was also better. This is consistent with the results of Examples 1, 2, and 3 above.

Short Contact Time FCC with Clean and Conventional Feeds

| Catalyst | 3A | ZF | ZE | ZE | ZF |
|---|---|---|---|---|---|
| Feed | HA6 | HA6 | HA6 | RC | RC |
| Contact Time, sec | 2 | 2 | 2 | 4 | 6 |
| Temperature, °C. | 480 | 480 | 480 | 485 | 485 |
| Conversion (220° C.) | 65 | 86 | 86 | 67 | 67 |
| Yields, Wt % | | | | | |
| Coke | 0.4 | 1.2 | 2.0 | 3.7 | 2.6 |
| Total $C_1$–$C_3$ | 5 | 7 | 7 | 6 | 6 |
| $C_3$ Olefins/Sats | 23 | 12 | 8 | 6 | 9 |
| 15–220° C. Naphtha | 51 | 62 | 60 | 49 | 51 |
| 15–220° C. Naphtha | | | | | |
| Aromatics | 15 | 29 | 30 | 26 | 29 |
| Olefins | 60 | 30 | 25 | — | — |

Clean feed (HA6) conversion with the intermediate and high unit cell size zeolite-containing catalysts was substantially higher than conversion obtained with the conventional feed (RC). On the other hand, the naphtha product was just as aromatic as the product from the conventional feed. Cat naphthas produced from the clean feed and the intermediate and high unit cell size catalysts were twice as aromatic as the naphtha produced from the clean feed and the amorphous 3A catalyst. It is believed that the key to these results is that aromatics were formed from the clean feed as a result of over-cracking and secondary hydrogen-transfer reactions which were promoted by the intermediate/high unit cell size zeolites. These undesirable reactions occurred even at the short contact times and low cracking temperature employed for these transfer-line experiments.

EXAMPLE 5

Conventional feed cracking tests with an amorphous silica-alumina catalyst (3A) were conducted in a laboratory dense-bed pilot unit. This unit was operated at conditions typical of commercial fluid catalytic cracking operations used with amorphous cracking catalysts.

The feed used for these experiments was typical of the feeds cracked commercially with amorphous silica-alumina catalysts and is designated RD. This feed is not a clean feed of this invention, but is much less aromatic and contains less organic nitrogen than conventional fluid catalytic cracker feeds described in the previous examples. The properties of the feed is set forth in Table XII below.

TABLE XII

| RD Feed Properties | |
|---|---|
| W ppm N | 244 |
| Wt % S | 0.40 |
| Wt % C | 86.69 |
| Wt % H | 12.92 |
| % Saturates. | 51.4 |
| % 1 Ring-Aromatics | 9.2 |
| % Total Aromatic Cores | 20.0 |
| % 2 + Ring Arom. Cores | 14.8 |

Cracking performance, yields, and product qualities are set forth in Table XIII below. Contact times are longer, catalyst to oil ratios are higher, cracking temperatures are higher, and space velocities are lower than those employed in the transfer-line fluid catalytic cracking experiments described in the previous example. Severe conditions are required to crack this feed with an amorphous silica-alumina catalyst. This is because the 244 wppm of nitrogen and 15% 2+ring aromatic cores poison the amorphous catalyst to a much greater extent than the clean feeds used in previous examples. Consequently, more severe cracking conditions are required to achieve conversions of 50% or more. At these conditions, naphthas produced from the RD feed are as aromatic as naphthas produced by transfer line cracking of more aromatic, conventional feeds and high unit cell size catalysts. Apparently, naphtha aromatics are formed from the RD feed at the long contact times required to crack this less aromatic feed with a "poisoned" 3A silica-alumina catalyst.

TABLE XIII

| Cracking of Feed on Si—Al Catalyst (3A) | | | | |
|---|---|---|---|---|
| Cat/Oil Ratio | 7.1 | 3.7 | 12.1 | 7.8 |
| WHSV | 14.1 | 12.9 | 14.1 | 6.5 |
| Conversion (220° C.), vol % | 51.5 | 47.6 | 58.0 | 62.4 |
| Yields | | | | |
| Coke, wt % | 2.18 | 1.59 | 3.13 | 3.76 |
| $C_1$–$C_3$, wt % | 5.9 | 5.5 | 7.3 | 9.3 |
| $C_4H_8$, wt % | 8.1 | 6.9 | 9.7 | 10.3 |
| $C_4H_{10}$, vol % | 4.4 | 3.4 | 6.1 | 7.9 |
| $C_5$/220° C., vol % | 42.0 | 40.3 | 44.1 | 43.5 |
| LCCO | 25.1 | 23.9 | 22.4 | 21.8 |
| Bottoms | 22.5 | 27.7 | 19.0 | 15.1 |
| 15-220° Naphtha | | | | |
| Aromatics | 27.0 | 25.5 | 26.5 | 32.0 |
| Olefins | 44.5 | 48.0 | 41.5 | 34.0 |

EXAMPLE 6

Clean feed cracking tests were conducted in the MAT testing unit described in Example 1. However, these tests were conducted at less sever conditions than the tests described in Example 1. Run conditions were as follows:

| | |
|---|---|
| Temperature, °C. | 482 |
| Run Time, Sec. | 80 |
| Catalyst Charge, gr. | 5.0 |
| Amount Feed, cc. | 2.0 |
| Cat/Oil ratio | 2.9 |

Three product are recovered for analysis: reactor gas, total liquid product, and spent catalyst. Reactor gas was analyzed by mass spectrometry. Liquid product was analyzed by gas chromatography to determine $C_5$/220° C., 200°/345° C., and 345° C.+ fractions. Spent catalyst was analyzed for carbon and coke yields are then calculated assuming 7.4 wt. % H in coke.

Two clean feeds were used for these experiments. These feeds were prepared by extracting aromatics compounds from a petroleum VGO in a commercial lubes process. The raffinate from this lubes process was then dewaxed or separated into a dewaxed oil (naphthenic) fraction and a slack wax (paraffinic) fraction. The paraffinic clean feed is designated as Feed HP; the naphthenic feed is designated as Feed HN. Properties of the two feeds are given in Table XIV below along with the properties of a more conventional fluid catalytic cracking feed.

TABLE XIV

| Feed | HN | HP |
|---|---|---|
| W ppm N | 53 | 6 |
| Wt % S | 0.202 | 0.137 |
| Wt % C | 86.39 | 85.66 |
| Wt % H | 13.55 | 13.88 |
| % Saturates | 79.2 | 85.3 |
| % 1 Ring-Aromatics | 17.3 | 12.1 |
| % Total Aromatic Cores | 2.8 | 1.8 |
| % 2 + Ring Arom. Cores | 2.6 | 1.7 |

These feeds were cracked with several fresh, steamed catalysts and a commercial equilibrium catalyst. Three of these fresh, steamed catalysts had comparable zeolite contents, about 40 wt. %, but with widely different unit cell sizes. One of the fresh, steamed catalysts, 3A, was an amorphous, silica-alumina gel. The equilibrium catalyst contained a lower zeolite content than the fresh, steamed catalysts. Detailed catalyst inspections and the catalyst designations are given in Table XV below. This table also lists the cracking activity, as measured by a standard MAT test, for a conventional petroleum feed. Catalysts 3A and ZI are catalysts of this invention; catalysts ZG, ZH, and ZJ are not.

TABLE XV

| CATALYST PROPERTIES | | | | | |
|---|---|---|---|---|---|
| Catalyst | Zeolite Content, Wt. % | Zeolite Unit Cell, Å | Catalyst $Al_2O_3$, Wt. % | Surface Area, $m^2$/gm | MAT Conversion % |
| ZG | 40 | 24.50 | 25.2 | 181 | 82 |
| ZH | 40 | 24.31 | 45.1 | 176 | 68 |
| ZI | 40 | 24.23 | 25.3 | 185 | 53 |
| ZJ | 17 | 24.35 | 31.6 | 92 | 69 |
| 3A | 0 | — | 25.0 | 122 | 42 |

Results for the cracking experiments are shown in the tables XVI and XVII below. Conversion obtained with the amorphous silica-alumina catalyst, 3A, was equivalent to conversion obtained with the low unit cell size zeolite catalyst, ZI. Moreover, conversion for both the low unit cell size zeolite catalysts and the amorphous catalysts were nearly equivalent to the conversion obtained with the large unit cell size zeolitic catalysts, which are much more active for converting conventional fluid catalytic cracking feeds. For this naphthenic feed, the amorphous silica-alumina catalyst is preferred over the low unit cell size catalyst as well as the larger unit cell size catalysts, since it provides much better selectivity for $C_3$ and $C_4$ olefins. This example illustrates that light olefins selectivity is affected by catalyst hydrogen-transfer activity as well as cracking activity.

TABLE XVI

| | Naphthenic Clean Feed HN | | | | |
|---|---|---|---|---|---|
| Catalyst | 3A | ZI | ZJ | ZH | ZG |
| Conversion | 81.2 | 80.0 | 86.5 | 87.2 | 90.2 |
| Yields, Wt % | | | | | |
| Coke | 1.16 | 1.46 | 2.48 | 2.74 | 5.31 |
| Hydrogen, | .020 | .020 | .017 | .036 | .026 |
| Dry Gas | 0.69 | 0.70 | 0.98 | 1.04 | 1.54 |
| Total $C_3$ | 3.93 | 3.42 | 3.49 | 3.7 | 7.38 |
| $C_3$ Olefins/Sats | 7.91 | 5.23 | 1.99 | 2.38 | 0.497 |
| Total $C_4$ | 6.34 | 5.91 | 5.69 | 6.66 | 7.69 |
| $C_4$ Olefins/Sats | 1.29 | 0.563 | 0.3 | 0.29 | 0.131 |
| 15-220° C. Naphtha | 69.1 | 68.6 | 74.1 | 73.0 | 68.3 |
| LCCO | 16.5 | 11.5 | 13.5 | 12.8 | 8.8 |
| BTMS | 2.2 | 8.4 | 0.0 | 0.0 | 1.0 |
| $C_3 + C_4$ Olefins/Sats | 2.20 | 1.15 | 0.66 | 0.66 | 0.28 |

A different conclusion is reached for the paraffinic, slack wax feed. In this case, the amorphous silica alumina catalyst was substantially less active than the low unit cell size catalyst ZI and the larger unit cell size catalysts. In fact, the conversion obtained with the low unit cell size catalyst was nearly as high as the conversion obtained with the nominally "more active", higher unit cell size catalysts. Moreover, the low unit cell size catalyst provided much higher selectivity for propylene and butylene products, or higher olefins yields at the same conversion, than the higher unit cell size catalysts. While the amorphous catalyst provided higher olefins yields than the ZI catalyst, it's not clear that it would offer better olefins selectivity at the same conversion. The results of these experiments show that a low unit cell size, zeolitic catalyst, is preferred for cracking paraffinic clean feeds.

TABLE XVII

| | Paraffinic Clean Feed HI | | | | |
|---|---|---|---|---|---|
| Catalyst | 3A | ZI | ZJ | ZH | ZG |
| Conversion, % | 68.6 | 84.2 | 83.0 | 87.4 | 88.1 |
| Yields, Wt % | | | | | |
| Coke | 1.00 | 1.19 | 2.83 | 2.69 | 5.50 |
| Hydrogen, | .016 | .015 | .010 | .020 | .025 |
| Dry Gas | 0.42 | 0.50 | 0.73 | 0.92 | 1.26 |
| Total $C_3$ | 3.45 | 4.11 | 3.03 | 3.92 | 4.19 |
| $C_3$-Olefins/Sats | 5.42 | 5.32 | 2.09 | 2.73 | 0.883 |
| Total $C_4$ | 8.27 | 6.53 | 5.65 | 5.61 | 8.00 |
| $C_4$-Olefins/Sats | 2.34 | 0.829 | 0.454 | 0.254 | 0.2 |
| 15-220° C./Naphtha | 55.4 | 72.0 | 70.7 | 74.2 | 69.2 |
| LCCO | 9.0 | 10.4 | 11.3 | 9.2 | 6.5 |
| Bottoms | 22.4 | 5.3 | 5.8 | 3.4 | 5.4 |
| $C_3 + C_4$ Olefins/Sats | 2.89 | 1.52 | 0.78 | 0.73 | 0.37 |

Taken together, the results of these experiments show that light olefins selectivity/yields are affected by several factors, not simply nominal catalyst activity for cracking a conventional feed.

EXAMPLE 7 (COMPARATIVE)

Cracking tests were conducted with conventional feeds in the MAT testing unit using the same operating conditions described in Example 6 above. The tests do not represent an example of this invention and were made to compare with the more favorable results disclosed in Example 6.

Tests were made with an equilibrium catalyst ZE as described in Example 4 above. This catalyst had a relatively large unit cell size (24.38 A), rare earth exchanged zeolite.

The feed used for these experiments is designated RE and was a conventional fluid catalytic cracking feedstock obtained from a commercial refinery. It is similar to the raw Arab Light VGO described in Example 1. It is not a clean feed as required by the practice of this invention. The properties of the feed are set forth in Table XVIII below.

TABLE XVIII

| | |
|---|---|
| W ppm N | 633 |
| Wt % S | 1.15 |
| Gravity, °API | 22.5 |
| % Saturates | 54.7 |
| % 1 Ring-Aromatics | 18.7 |
| % Total Aromatic Cores | 14.9 |
| % 2 + Ring Arom. Cores | 11.5 |

The total liquid product from these tests were analyzed in accordance with the same procedures described in Example 6 above and the results are set forth in Table XIX below. As shown, conversion was substantially increased by increasing the cat/oil ratio from 1.7 to 3.9. At the same time, propylene and butylene yields also increased, but not to the same extent as did saturated light gases. Olefins were substantially selectivity reduced, by about ½, as conversion increased. This data in this example are in contrast to data obtain with the clean feeds and the catalysts of this invention which are the subject of Example 6.

TABLE XIX

| Cracking of Conventional Feed RE on Large Unit Cell Size Catalyst | | | | |
|---|---|---|---|---|
| Cat/Oil Ratio | 1.7 | 2.2 | 2.8 | 3.9 |
| Conversion (220° C.), % | 45.5 | 58.1 | 63.1 | 71.5 |
| Yields, Wt % | | | | |
| Coke | 1.92 | 2.86 | 3.60 | 4.82 |
| Dry Gas | .71 | 1.00 | 1.17 | 1.58 |
| $C_3H_6$ | 1.76 | 2.35 | 2.42 | 3.03 |
| $C_3H_8$ | 0.52 | 0.80 | 1.00 | 1.62 |
| $C_4H_8$ | 1.51 | 1.66 | 1.61 | 1.83 |
| $C_4H_{10}$ | 2.41 | 3.43 | 3.91 | 5.62 |
| 15-220° C. Naphtha | 37.0 | 46.0 | 49.4 | 53.6 |
| LCCO | 20.1 | 21.1 | 19.8 | 17.9 |
| Bottoms | 34.4 | 20.6 | 17.1 | 10.6 |
| $C_3 + C_4$ Olefins/Sats | 1.12 | 0.94 | 0.82 | 0.67 |

What is claimed is:

1. A fluid catalytic cracking process for producing low emissions fuel products, which process comprises the steps of:

(a) introducing a hydrocarbonaceous feedstock into a reaction zone of a catalytic cracking unit, which feedstock is characterized as having: an initial boiling point from about 230° C. to about 350° C., with end points up to about 620° C.; a nitrogen content less than about 50 wppm; a hydrogen content in excess of about 13 wt. %; a 2+ring aromatic core content of less than about 7.5 wt. %; and an overall aromatic core content of less than about 15 wt. %;

(b) catalytically cracking said feedstock in said reaction zone at a temperature from about 450° C. to about 600° C., by causing the feedstock to be in contact with a cracking catalyst for a contact time of about 1 to 5 seconds, which cracking catalyst is selected from the group consisting of: (a) an amorphous acidic catalytic material; and (b) a catalyst material containing a faujasite having a unit cell size less than about 24.25 Å; thereby producing lower boiling products and spent catalyst particles which contain coke and hydrocarbonaceous material; and (c) stripping said spent catalyst particles with a stripping medium in a stripping zone to remove therefrom at least a portion of said hydrocarbonaceous material;

(d) recovering said stripped hydrocarbonaceous material from the stripping zone;

(e) regenerating said coked catalyst in a regeneration zone by burning-off a substantial amount of the coke on said catalyst, and optionally an added fuel component, to maintain the regenerated catalyst at a temperature which will maintain the catalytic cracking reactor at a temperature from about 450° C. to about 600° C.; and (f) recycling said regenerated catalyst to the reaction zone.

2. The process of claim 1 wherein the catalyst is an amorphous silica-alumina material.

3. The process of claim 2 wherein the silica-alumina material contains from about 10 to 40 wt. % alumina.

4. The process of claim 1 wherein the catalyst is zeolitic material in an inorganic matrix, which zeolitic material is a Y type zeolite having a unit cell size of 24.25 Å or less.

5. The process of claim 1 wherein the hydrocarbonaceous feedstock contains: less than about 20 wppm nitrogen, greater than about 13.5 wt. % hydrogen, less than about 4 wt. % of 2+ring aromatic cores, and an overall aromatic core content of less than about 8 wt. %.

6. The process of claim 5 wherein the catalyst is an amorphous silica-alumina material containing from about 10 to 40 wt. % alumina.

7. The process of claim 5 wherein the catalyst is zeolitic material in an inorganic matrix, which zeolitic material is a Y type zeolite having a unit cell size of 24.25 Å or less.

* * * * *